United States Patent [19]

Wiley

[11] Patent Number: 4,737,995

[45] Date of Patent: Apr. 19, 1988

[54] CHILD'S HOSPITAL UNIFORM

[76] Inventor: Dorothy Wiley, 655 N. Almond St., Dixon, Calif. 95620

[21] Appl. No.: 23,677

[22] Filed: Mar. 9, 1987

[51] Int. Cl.[4] ..... A41B 9/00

[52] U.S. Cl. ..... 2/114; 2/51; 2/DIG. 7

[58] Field of Search ..... 2/114, DIG. 7, 51

[56] References Cited

U.S. PATENT DOCUMENTS

| | | | |
|---|---|---|---|
| 818,351 | 4/1906 | Clark | 2/114 |
| 2,479,246 | 8/1949 | Lupo | 2/DIG. 7 |
| 2,520,026 | 8/1950 | Beitchman | 2/DIG. 7 |
| 3,276,036 | 10/1966 | Cater | 2/114 |
| 4,055,855 | 11/1977 | Ragone | 2/114 |
| 4,422,186 | 12/1983 | Loney | 2/114 |
| 4,612,673 | 9/1986 | Underhill | 2/114 |
| 4,644,589 | 2/1987 | Pettis | 2/114 |
| 4,651,353 | 3/1987 | Walden | 2/114 X |

*Primary Examiner*—Louis K. Rimrodt
*Attorney, Agent, or Firm*—Mark C. Jacobs

[57] ABSTRACT

A two part hospital uniform for children having a gown with selectively severable shoulder portions, an easy fit neck and pockets which gown may be used alone or in conjunction with unisex trousers.

3 Claims, 2 Drawing Sheets

CHILD'S HOSPITAL UNIFORM

To almost all children a stay in a hospital is quite traumatic. Therefore anything that can be done to relieve the adversity is most desirable.

One problem that kids encounter at the hospital is the difficulty in dressing and undressing in the unfamiliar hospital gown, especially when the child is connected to an IV or other tubing.

It is an object therefore to provide an improved hospital uniform for children.

It is another object of this invention to provide a hospital outfit that includes a novel gown and pajama type bottoms.

It is yet another object to provide a hospital uniform, the gown portion of which features severable shoulder sections.

A further object is to provide a child's hospital gown that also features pockets for the storage of attention diverters.

A yet further object is to provide a hospital uniform wherein the gown has a non-binding neck area and raglan sleeves.

Other objects of the invention will in part be obvious and will in part appear hereinafter.

The invention accordingly comprises the apparatus possessing the construction, combination of elements and arrangement of parts which are exemplified in the following detailed disclosure, and the scope of which will be indicated in the claims.

SUMMARY OF THE INVENTION

Figure 1:
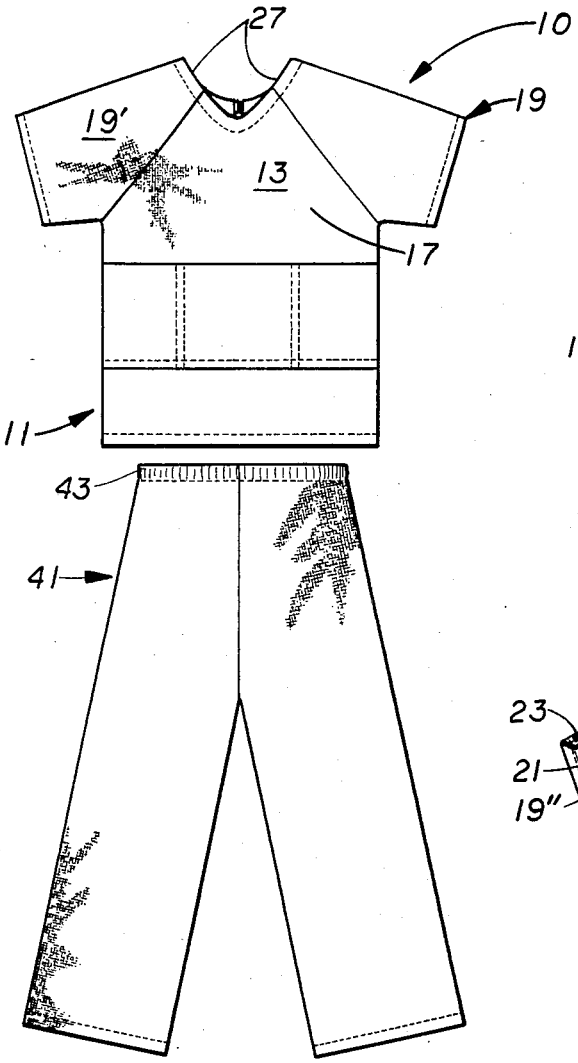
FIG. 1 is a front plan view of the children's hospital uniform of this invention.

A new children's hospital uniform with a unisex bottom and a gown featuring selectively severable shoulder section attention diverter front pockets, and an easy fit neckline and raglan sleeves.

DESCRIPTION OF THE PREFERRED EMBODIMENT

In the description set forth herein, like numbers will reflect to like parts in the several views.

The uniform of this invention consists of two portions the gown portion and bottom portion. Since the bottom portion is used as an adjunct to the gown, the emphasis will be placed on the discussion of the gown portion. The gown is constructed by overlaying a plurality of panels, each of which is cut and configured as shown in the drawings, which panels are then sewn together to form the garment.

The gown is formed from seven panels (see FIG. 7), which are designated A; B; B'; C; C'; D and D', as will be recited below. Panels B, C and D are mirror image sections of those designated B', C' and D'.

In most instances fabric is preferably folded over slightly at the edge in order to avoid raw edges, as is known in the art to seamstresses. For the purpose of this discussion, no distinction will be drawn between rough and smooth edges, and only the term edge will be employed. Folded over or smooth edges, where applicable are contemplated herein.

Since the gown is similar on either side of the vertical center axis, for the purpose of brevity discussion will be limited to the sewing of one side only, but is of course equally applicable to both sides.

Figure 7:
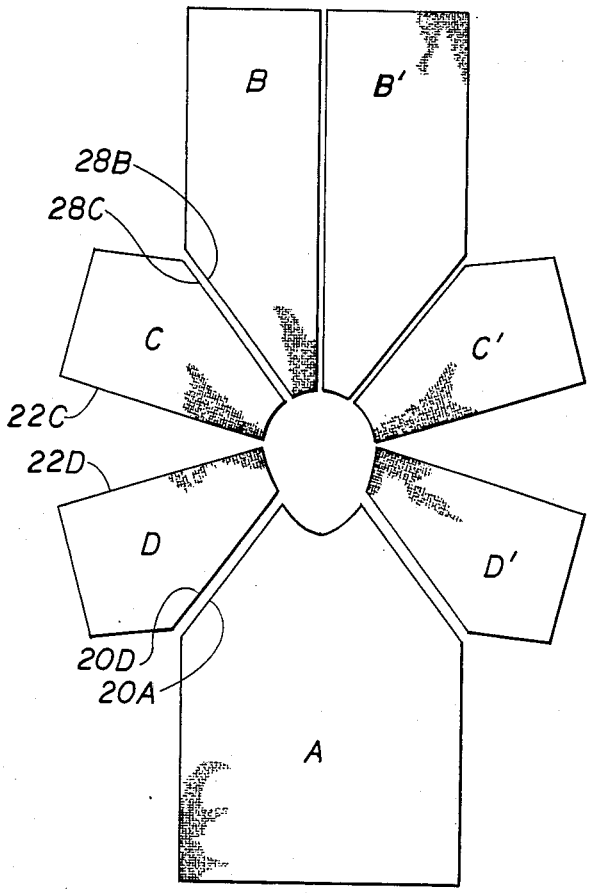
FIG. 7 is an exploded view of the various panels employed to make the gown pattern. The pockets and ties have been omitted for ease of understanding.

In the discussion to follow, odd numbers will be used to refer to designated parts, while letters will refer to the panels that comprise the structure, and which are seen in FIG. 7, while even numbers will refer to edges or seams of panels or parts.

Turning first to FIG. 1 there is shown the invention 10 comprising a gown portion 11 and a trouser portion 41. Gown portion 11 has a front 13 and a back side 13'. The front is composed of a main body section or bib 17 and the front part 19' of each of the sleeves 19. The bib 17 also includes a V neck 27 for a non clinging easy on and easy off neckline.

Figure 3:
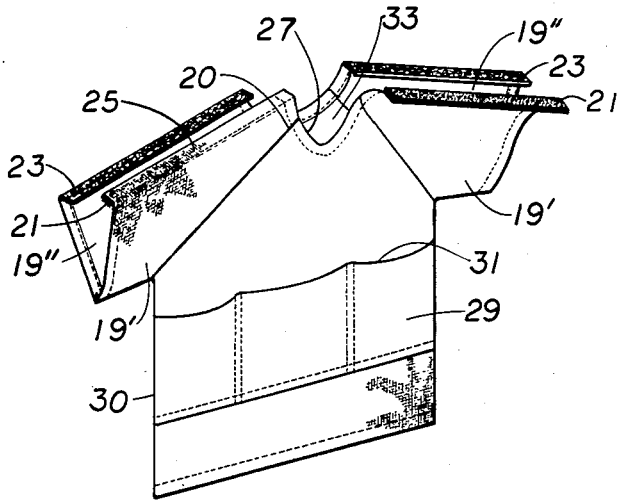
FIG. 3 is a view similar to FIG. 2 showing the separation of the shoulder sections, and both the front and back portions.

Shown in FIGS. 1 and 3 are the preferred presence of one or more pockets 29 which are top accessible, the numeral 31 designating the top opening. The pockets are referred to as attention diverting pockets as children can stow a small toy, crayon or other trifles therein to help them forget their pain and/or injury. While three pockets are shown the number can vary down to one patch pocket. Thus pockets 29 are referred to as patch pockets since the rear wall of the pocket is the cloth of the bib itself. Such a construction is well known from the men's blazer art.

Sleeves 19 are of the raglan type rather than the set-in variety, again for the benefit of the comfort of the wearer. Thus front sleeve section 19' attaches to the bib 17 along seam 20, which seam 20 is shown in FIG. 3. Reference is also made to FIG. 7 as this seam 20 would be sewn at the interface of panel edges 20D and 20A.

Figure 4:
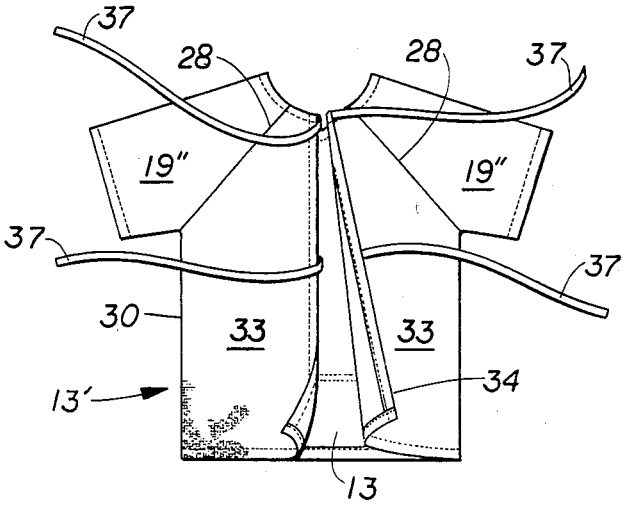
FIG. 4 is a rear perspective view of the gown of this invention.

The rear or back side 13' of the gown 11 is shown in FIG. 4.

The back side 13' is comprised of two mirror image half rear sections 33 each of which has along their vertical inside edge 34, a plurality,—here three—of vertically spaced tie straps 37. These are the panels designated B of FIG. 7.

Attached to each half rear section 33 is the rear section 19'' of sleeve 19. Here the seam of the raglan construction is designated 28 per FIG. 4. Reference is also made to 28B and 28C as the respective edges to be sewn together to form seam 28.

Except for the shoulder "seam" 22 to be discussed below, conventional sewing techniques are used to form the gown from the several panels. Thus standard hemming techniques may be employed along edges 34 of the half rear sections; the end of the sleeve 19, and along the neckline. Standard lap seams are used elsewhere herein such as at 30 the junction of the front and rear sections of the gown.

Figure 2:
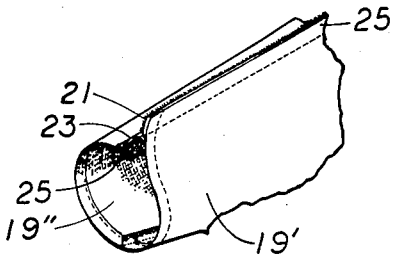
FIG. 2 is a closeup perspective view of the shoulder section of the gown portion of this invention.

Turning now to FIG. 2 it is seen that the "seam" 22 along the shoulder that joins the upper edges of sleeve section 19' and 19'' is a Velcro® closure rather than a hem or a seam. Velcro is a product patented by Velcro S.A. of Fribourg Switzerland, the disclosure of which is recited in U.S. Pat. Nos. 2,717,437; 3,009,235 among others. Velcro brand closure constitutes first and second interengageable cooperating interlocking means one of which is comprised of hooks, the other of loops to which the hooks attach releaseably. Strips of this material are readily available in the marketplace.

The "seam" 22 can be a standard junction of the edges of two pieces of cloth, or as is shown and preferred in FIG. 2, an overlapping junction. Here the male 21 and female 23 Velcro members are attached as by glue or a self adhesive rear backing strip to the tabs 25. As is seen from the comparison of FIGS. 2 and 3 the male Velcro strip 21 and female strip 23 may be placed on either tab 25 of the two sleeve sections 19' and 19".

The gown 11 as shown has both sleeves open so that the arms of the wearer can protrude through. This is clearly seen from FIG. 3.

Figure 5:
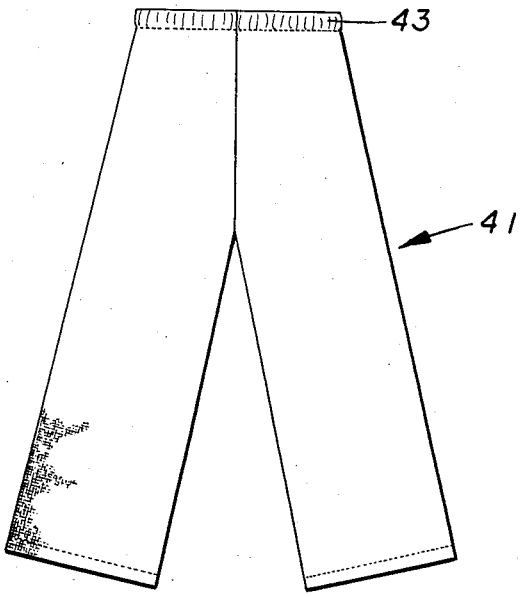
FIG. 5 is a rear plan view of the trouser bottom of this invention.

The gown 11 of this invention may be worn above or preferably in combination with the trousers 41 shown in FIGS. 1 and 5. These trousers feature an elastic waist band 43 and have a no fly front. Thus they are seen to be unisex pants. The advantage of this is that the hospital can reduce inventory costs by only having one style of trousers 41. Trousers 41 are otherwise of a standard construction, similar in some ways to a pajama bottom.

Figure 6:
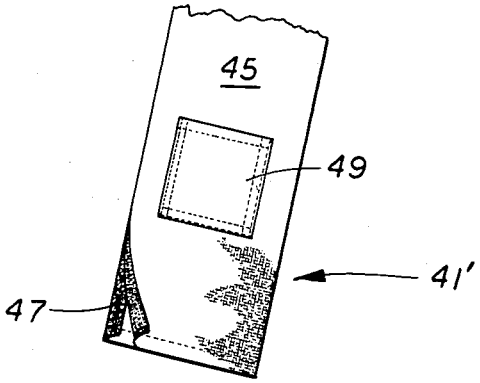
FIG. 6 depicts a closeup of a variant thereof.

Shown in FIG. 6 is a second embodiment or variant of trousers 41 designated 41'. Here the pant leg 45, features a patch pocket, that is top accessible, and designated 49 on at least one of the two pant legs. In addition the outside seam 47 instead of being sewn is of a Velcro construction. Such a feature allows easy access to the leg of the wearer as for burn treatment, or the placement of IVs therein or a brace thereon. Naturally one or both of these variant features can be found on one or both legs 45 of trousers 41'.

The hospital outfit for kids as described above may be made in any suitable wash and wear fabric such as a polyester and cotton blend. It may be made in sizes 2 to 14 inclusive. The outfit, if for kids should be decorated with some type of indicia such as a teddy bear or two.

The outfit can also be made in adult sizes as well for wear by both men and women.

The trousers are to be worn during periods that the patient is ambulatory for both modesty and warmth.

It is seen that I have provided an improved hospital outfit that is tied together at the rear by the ties 37 and which gown can be "stepped" into by children and adults due to the nature of the shoulder construction employed. The trouser section having no fly, has no front or rear and is thus easily put on by males and females alike. The optional open leg with Velcro closure is a benefit for overweight people, and for those required to wear a brace on their leg.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. An improved hospital outfit comprising in combination:

a first part designed to encase the upper torso and limbs of the wearer, and a second part designed to encase the lower torso and limbs of the wearer;

said first part comprising a body member having a V-neck; a bib front; raglan sleeves, each of which has a shoulder seam formed of 2 Velcro strips disposed along the top edge portions of said sleeve; two mirror image half rear sections each of which has an inner vertical edge and vertically spaced ties disposed, along each of the half rear sections inner vertical edge, and at least one top accessible pocket on the bib front of the first part;

said second part comprising a trouser member having a pair of leg encasing sections and a portion adapted to encircle the lower torso of the wearer, said member including a pair of mirror image panels, said panels being superimposed and joined together by an elastic waist band, and by inner leg seams, the outside leg seams being formed, at least in part by two Velcro strips disposed along matching outer edge portions of the leg encasing sections.

2. The hospital outfit of claim 1 further including at least one patch pocket mounted on the second part thereof.

3. The hospital outfit of claim 1 wherein each leg encasing section of the rear end part has a front mounted patch pocket thereon.

* * * * *